US009273891B2

(12) United States Patent
Boarman et al.

(10) Patent No.: US 9,273,891 B2
(45) Date of Patent: Mar. 1, 2016

(54) ROTATIONAL ICE MAKER

(71) Applicant: Whirlpool Corporation, Benton Harbor, MI (US)

(72) Inventors: Patrick J. Boarman, Evansville, IN (US); Brian K. Culley, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 477 days.

(21) Appl. No.: 13/713,147

(22) Filed: Dec. 13, 2012

(65) Prior Publication Data

US 2014/0165621 A1 Jun. 19, 2014

(51) Int. Cl.

| | |
|---|---|
| ***F25C 1/10*** | (2006.01) |
| ***F25C 5/04*** | (2006.01) |
| ***F25B 21/02*** | (2006.01) |

(52) U.S. Cl.

CPC . *F25C 5/04* (2013.01); *F25B 21/02* (2013.01); *F25C 1/10* (2013.01)

(58) Field of Classification Search

CPC ..... F25C 1/10; F25C 1/20; F25C 1/18; A23G 9/083; A23G 9/106; A23G 9/221

USPC ..... 62/68

See application file for complete search history.

(56) References Cited

U.S. PATENT DOCUMENTS

| | | | | |
|---|---|---|---|---|
| 6,357,720 | B1 * | 3/2002 | Shapiro et al. | 249/119 |
| 2004/0099004 | A1 * | 5/2004 | Somura | 62/347 |
| 2006/0086130 | A1 * | 4/2006 | Anselmino et al. | 62/344 |

FOREIGN PATENT DOCUMENTS

| | | | | |
|---|---|---|---|---|
| CN | 1989379 | | 6/2001 | |
| FR | 2771159 | | 5/1999 | |
| JP | 60141239 | | 7/1985 | |
| JP | 13105277 | | 12/1989 | |
| JP | 20316499 | | 2/1990 | |
| JP | 2140575 | | 5/1990 | |
| JP | 4015069 | | 1/1992 | |
| JP | 06-11219 | * | 1/1994 | F25C 1/18 |
| JP | 10253212 | A | 9/1998 | |
| JP | 2001221545 | | 8/2001 | |
| KR | 2001109256 | | 12/2001 | |
| KR | 2006126156 | | 12/2006 | |
| KR | 2011037609 | | 4/2011 | |
| TW | 424878 | | 3/2001 | |

* cited by examiner

*Primary Examiner* — Cassey D Bauer

(57) ABSTRACT

An ice maker has an ice mold that includes a metallic piece and an insulated piece. A cooling source is thermally coupled to the metallic piece. A cavity is within the ice mold and has a first reservoir in the metallic piece and a second reservoir in the insulated piece. The first and second reservoirs align to substantially enclose the cavity. An intake aperture in the insulated piece extends to the cavity for receiving water. A drive body rotatably coupled to the ice mold that operates in an ice-making cycle, wherein the drive body repeatedly rotates the mold from an injection position to a tilted position. The cavity receives an incremental amount of water in the injection position and moves to the tilted position to freeze at least a portion of the incremental amount of water over a side surface of the cavity to make an ice piece.

9 Claims, 16 Drawing Sheets

ROTATIONAL ICE MAKER

CROSS-REFERENCE TO RELATED APPLICATION

The present application is related to patent application Ser. No. 13/713,199, filed Dec. 13, 2012, entitled ICE MAKER WITH ROCKING COLD PLATE, the entire contents of which are incorporated herein by reference.

FIELD OF THE INVENTION

The present invention generally relates to an ice maker for making ice with a rotational ice mold. More specifically, the invention relates to an ice maker for an appliance that is capable of making substantially clear ice spheres.

BACKGROUND OF THE INVENTION

During the ice making process when water is frozen to form ice, trapped air tends to make the resulting ice that is cloudy in appearance. The result is an ice cube which, when used in drinks, can provide an undesirable taste and appearance which distracts from the enjoyment of a beverage. Clear ice is significantly more desirable but requires processing techniques and structure which can be somewhat costly to efficiently include in consumer appliances.

SUMMARY OF THE INVENTION

According to one aspect of the present invention, an ice maker has an ice mold that includes a metallic piece and an insulated piece. A cooling source is thermally coupled to the metallic piece. A cavity is within the ice mold and has a first reservoir in the metallic piece and a second reservoir in the insulated piece. The first and second reservoirs align to substantially enclose the cavity. A fluid intake aperture in the insulated piece extends to the cavity for receiving water. A drive body rotatably coupled to the ice mold is configured to operate in an ice-making cycle, wherein the drive body repeatedly rotates the mold from an injection position to a tilted position. The cavity receives an incremental amount of water in the injection position and moves to the tilted position to freeze at least a portion of the incremental amount of water over a side surface of the cavity to make an ice piece.

According to another aspect of the present invention, an ice maker includes an ice mold that has a first piece removably engaged with a second piece. A spherical cavity is within the ice mold, such that the first and second pieces align to substantially enclose the cavity. An aperture in the mold extends into to the cavity for injecting water into the cavity. A thermoelectric device is thermally engaged with the second piece for freezing water in the cavity. An electrical drive body is rotatably coupled with the ice mold that is configured to rotate the mold from an injection position to a tilted position. The cavity receives water in the injection position. The mold rotates at least 45 degrees from the injection position to the tilted position to freeze water on a side portion of the cavity. A storage bin is positioned to receive an ice piece formed in the cavity when the first and second pieces disengage to release the ice piece.

According to yet another aspect of the present invention, a method of forming an ice piece includes providing an ice maker that includes an ice mold that has a top piece and a bottom piece. A cavity is within the ice mold having a first reservoir in the top piece and a second reservoir in the bottom piece, such that the first and second reservoirs align to substantially enclose the cavity. An aperture extends to the cavity for receiving water. The bottom piece of the ice mold is cooled with a cold source thermally coupled with the bottom piece. An incremental amount of water is injected into the cavity through the aperture. The ice mold is rotated about an axis of the cavity in a rocking cycle using a drive body coupled with the ice mold, causing the incremental portion of water to move between a first side portion of the cavity and a second side portion of the cavity. A portion of the incremental amount of water is frozen over the first and second side portions of the cavity. The injection and rotation steps are repeated to form an ice piece which substantially occupies the cavity.

These and other features, advantages, and objects of the present invention will be further understood and appreciated by those skilled in the art by reference to the following specification, claims, and appended drawings.

DETAILED DESCRIPTION

Figure 1:
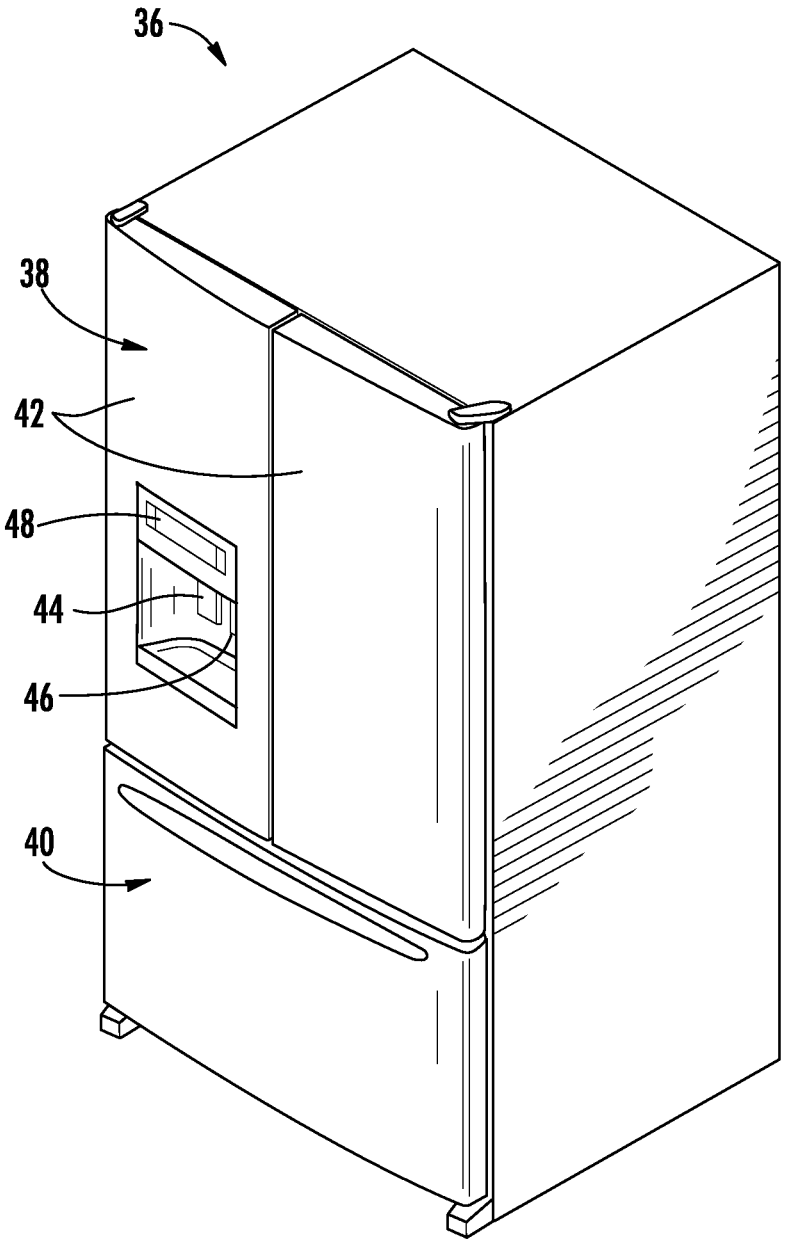
FIG. 1 is a top perspective view of an appliance having an ice maker of the present invention.

For purposes of description herein, the terms "upper," "lower," "right," "left," "rear," "front," "vertical," "horizontal," and derivates thereof shall relate to the customizable multi-stage fluid treatment assembly as oriented in FIG. 1. However, it is to be understood that the customizable multi-stage fluid treatment assembly may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-9A, an ice maker is generally identified with reference numeral 10. The ice maker 10 includes an ice mold 12 that has a first piece 14 removably engaged with a second piece 16. A cavity 18 is within the ice mold 12, such that the first and second pieces 14, 16 align to substantially enclose the cavity 18. An aperture 20 in the mold 12 extends into to the cavity 18 for injecting water into the cavity 18. A cooling source 22 is thermally engaged with the second piece 16 for freezing water in the cavity 18. A drive body 24 is rotatably coupled with the ice mold 12 that is configured to rotate the mold 12 from an injection position 26 to a tilted position 28. The cavity 18 receives water in the injection position 26. The mold 12 rotates from the injection position 26 to the tilted position 28 to freeze water on a side portion 30 of the cavity 18. A storage bin 32 is positioned to receive an ice piece 34 formed in the cavity 18 when the first and second pieces 14, 16 disengage to release the ice piece 34.

As illustrated in FIG. 1, a consumer appliance 36 is shown that has a refrigerator compartment 38 and a freezer compartment 40 cooled with at least one refrigeration circuit, as generally understood in the art. The freezer compartment 40 is enclosed with a sliding drawer and arranged below the refrigerator compartment 38. It is conceivable that the freezer compartment 40 may be alternatively arranged with hingeable doors or an alternative enclosure. The refrigerator compartment 38 is enclosed with two hingeable doors 42, in a French-style door arrangement. It is also conceivable that the refrigerator compartment 38 may include an alternative enclosure and include an alternative location and configuration relative to the freezer compartment. The left refrigerator door 42 includes an ice dispenser 44 and a water dispenser 46 proximate an interactive display 48 for a consumer to access water or ice without opening the refrigerator door 42. The consumer appliance 36 may conceivably include an appliance with only a refrigerator compartment, an appliance with only a freezer compartment, an appliance without an ice dispenser, an appliance with only an ice maker, and other conceivable appliances as one in the art would generally understand.

Figure 2:
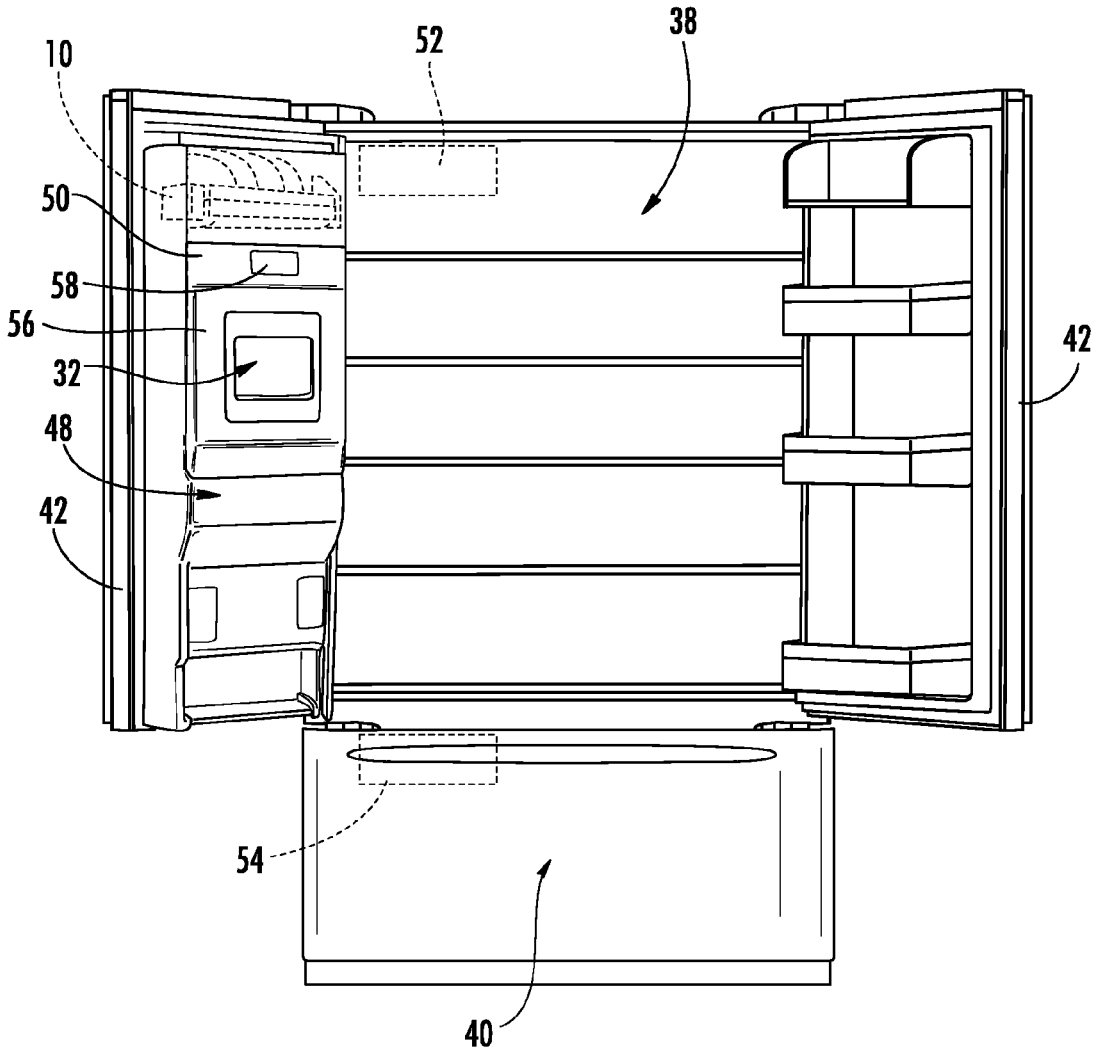
FIG. 2 is a front perspective view of the appliance with the appliance doors in an open position.

As shown in FIG. 2, the doors 42 enclosing the refrigerator compartment 38 are in an open position defined by the doors 42 pivoting away from the side walls of the refrigerator compartment 38 to allow an interior portion 48 of the door 42 to be accessible by a user. The ice maker 10 is shown encased by a housing 50 on the upper section of the interior portion 48 of the left door 42 enclosing the refrigerator compartment 38. It is conceived that the ice maker 10 may be alternatively located, such in an area 52 within the refrigerator compartment 38 or in a region 54 of the freezer compartment 40. The housing 50 enclosing the ice maker 10 includes an access panel 56 coupled with an intermediate section of the interior portion 48 of the left refrigerator door 42. The access panel 56 may be opened by a user by depressing a handle 58 and pivoting the access panel 56 outward about an axis along the bottom portion of the access panel 56. Upon actuating the handle 58, the user may expose the storage bin 32 that is positioned to receive ice pieces 34 from the ice maker 10. The storage bin 32 is also positioned to dispense ice pieces 34 to a user via the ice dispenser 44 (FIG. 1) on the exterior portion of the refrigerator door 42.

Figure 3:
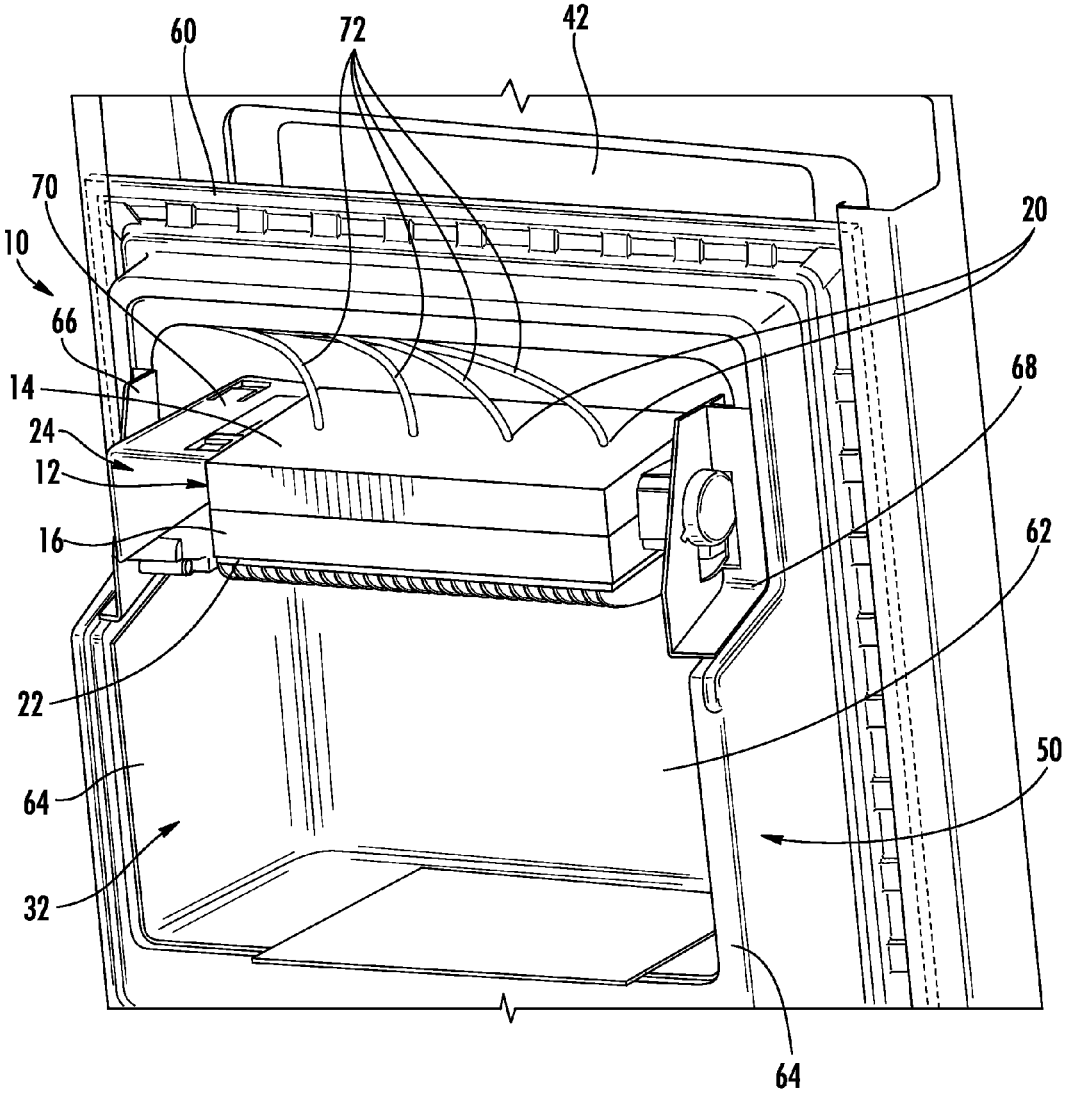
FIG. 3 is a top perspective view of an appliance door showing the ice maker.

As shown in FIG. 3, an upper portion of the housing 50 is removed from the ice maker 10 exposing both the storage bin 32 and the ice mold 12, among other features of the ice maker 10. The remaining portion of the housing 50 and the storage bin 32 shown includes a liner 60 of the appliance door 42. The liner 60 is molded to include a recessed section 62 that defines a portion of the ice storage bin 32. An upper portion of the recessed section 62 includes sidewalls 64 that have inward slanted segments that are configured to receive a first bracket 66 and second bracket 68 for mounting an ice maker 10. The first and second brackets 66, 68 are mounted on the sidewalls 64 of the recessed section 62 coupling with the slanted portions thereof. The first bracket 66 couples with the drive body 24 that rotatably couples with the ice mold 12. The drive body 24 is shown as an electrical drive body 24 partially enclosed with a shroud 70 that at least partially contains heat radiated from the drive body 24. However, it is conceivable that the drive body 24 may use an alternative power source, such as a mechanical drive body 24 that is actuated by a user. The second bracket 68 is pivotably coupled with the opposing side of the ice mold 12 to support the rotatable ice mold 12.

As also illustrated in FIG. 3, a plurality of water lines 72 extend from the upper portion of the door liner 60 to couple with the first piece 14 of the ice mold 12. The water lines 72 extend to a water source coupled with the appliance 36. In the illustrated embodiment, the water lines 72 extend from the refrigerator door 42 to a portion rearward of the refrigerator cavity 18 (FIG. 2), to couple with the water source. The water source conceivably includes a household water line; although, it is conceivable that the water source may alternatively include a user-refillable water basin that may be located in various locations throughout the appliance 36, including a location proximate the ceiling of the refrigerator compartment 38 and above the ice maker 10. The outlets of the water lines 72 fluidly couple with the intake apertures 20 on the first piece 14 of the mold 12 to inject water into the cavities 18 within the ice mold 12. It is also conceivable that a single water line may couple with each fluid intake aperture 20 on the first piece 14 of the ice mold 12.

Figure 4:
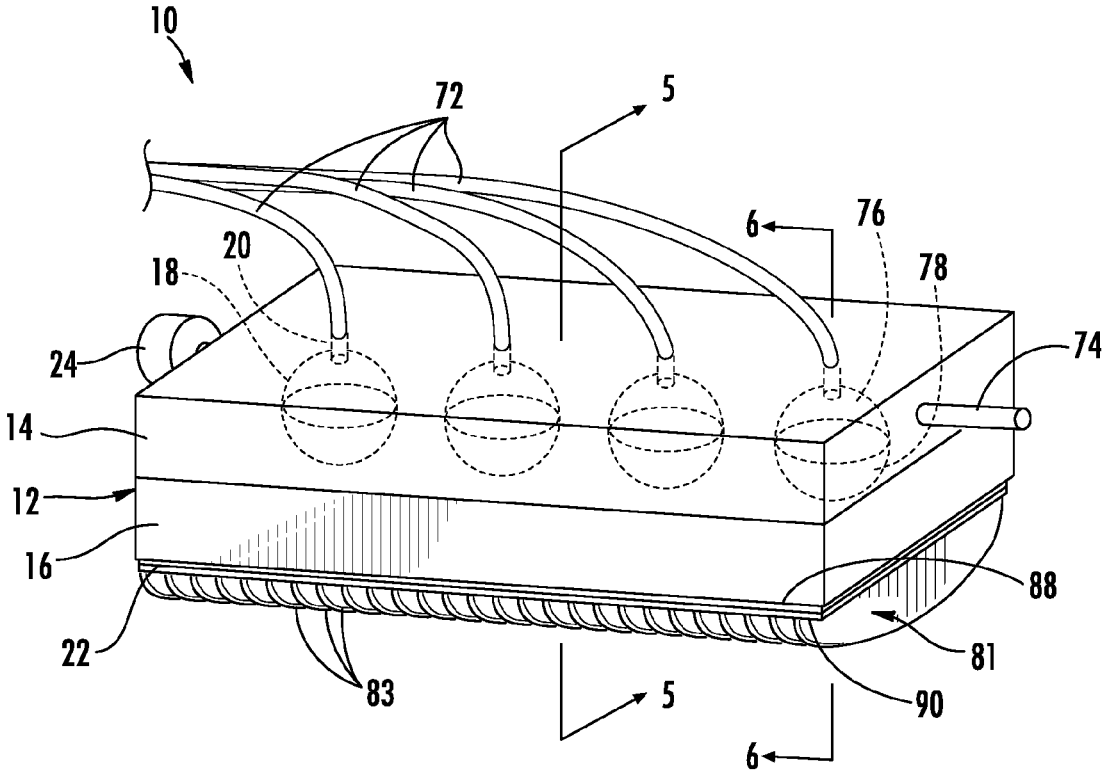
FIG. 4 is a top perspective view of the ice maker.

Referring now to FIG. 4, the illustrated embodiment includes four spherical cavities 18 spaced along a transverse axis 74 of the ice mold 12 and within the ice mold 12. Each cavity 18 has a first reservoir 76 in the first piece 14 and a second reservoir 78 in the second piece 16. The first and second reservoirs 76, 78 align to enclose the cavity 18 and each reservoir includes approximately a half of the cavity 18. As also illustrated, the electrical drive body 24 is coupled with the first piece 14 to oscillate the ice mold 12 in an ice making cycle. In the ice making cycle, the ice mold 12 rotates from the injection position 26 to the tilt position as explained in more detail below. It is conceivable that the ice mold 12 may include more or fewer cavities alternatively arranged from the illustrated embodiments, such as including multiple rows of cavities in parallel alignment with the transverse axis 74. It is also conceivable that the drive body 24 may be alternatively positioned and that more than one drive body 24 may be included.

As also illustrated in FIG. 4, the second piece 16 includes a cooling source 22 that is thermally coupled to a bottom surface of the second piece 16 to freeze water contained within the cavities 18. The cooling source 22, as illustrated, is a thermoelectric device 22 that has a cold side 88 thermally coupled with the bottom surface of the second piece 16 of the ice mold 12 and a hot side 90 thermally coupled with a heat sink 81. The thermoelectric device 22 is configured to transfer heat from the cold side 88 to the hot side 90 resulting in a temperature difference of at least twenty degrees between the hot side 90 and the cold side 88 with an appropriate voltage supplied to the thermoelectric device 22. The heat sink 81 that is coupled with the hot side 90 includes a plurality of fins 83 extending away from the ice mold 12. The heat sink 81 is configured to radiate heat away from the hot side 90 of the thermoelectric device 22, providing a cooling effect to the hot side 90. The fins 83 of the heat sink 81, as illustrated, extend substantially linearly across the cold side 88 substantially perpendicular to the transverse axis 74. The plurality of fins 83 are spaced along the transverse axis 74 of the ice mold 12 between the ends of the mold 12, proximate the first and second brackets 66, 68 (FIG. 3). It is conceivable that the heat sink 81 may include an alternative fin 83 arrangement to cool the hot side 90 of the thermoelectric device 22. It is also conceivable that the cooling source 22 may alternatively include an evaporator coil of a refrigeration circuit, a freezing air flow, or other conceivable cooling sources.

Figure 4A:
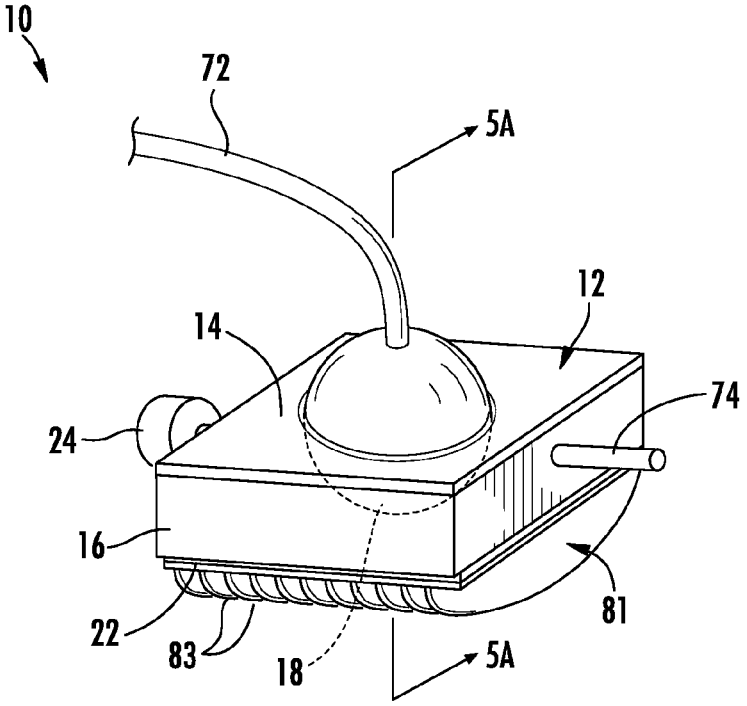
FIG. 4A is a top perspective view of an additional embodiment of the ice maker.

An additional embodiment of the ice maker 10 is illustrated in FIG. 4A, showing a single spherical cavity 18 within the ice mold 12. This additional embodiment includes the electrical drive body 24 rotatably coupled to the second piece 16 of the ice mold 12 to similarly oscillate the ice mold 12 in an ice making cycle. In this embodiment, a single water line extends to the ice mold 12 to fluidly couple with the cavity 18 therein. It is conceivable that multiple ice makers 10, as shown in FIG. 4A, may be arranged in the refrigerator door 42 or other locations within an appliance 36, such as a linear array of ice makers 10 that have transverse axes 74 in substantially parallel alignment.

Figure 5:
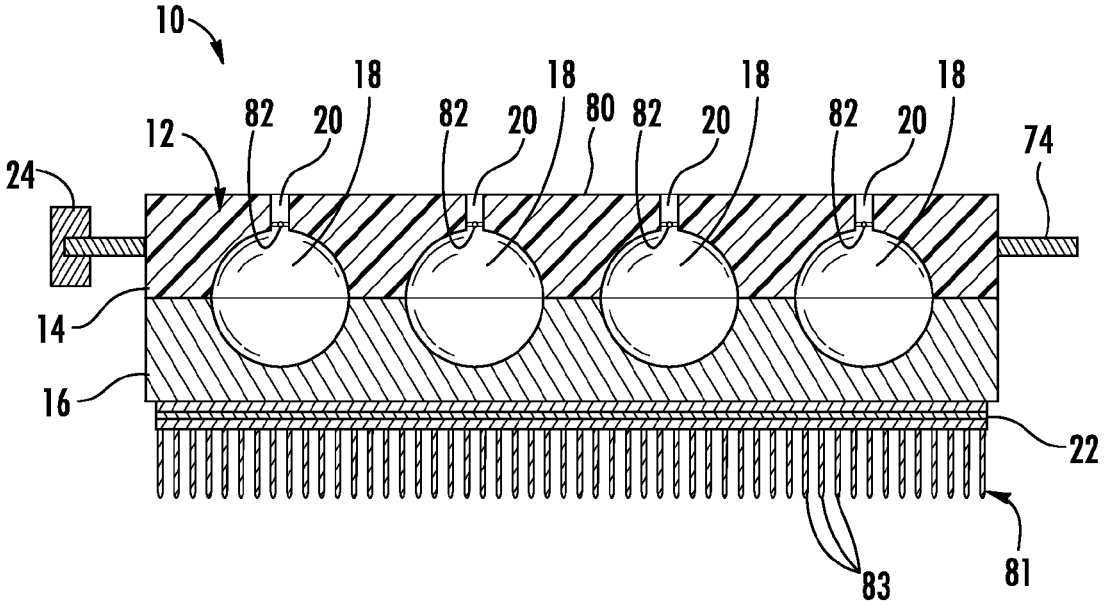
FIG. 5 is a cross-sectional side view of the ice maker of FIG. 4.

As shown in FIG. 5, the cavities 18 are disposed along a transverse axis 74 of the ice mold 12, and the cavities 18 include a spherical shape. The fluid intake apertures 20 extend from a top surface 80 of the first piece 14 of the mold 12 to a highest vertical portion of each cavity 18. As such, the fluid intake apertures 20 are configured to allow the cavities 18 to be entirely filled with water. A valve 82 is positioned between the fluid intake aperture 20 and the cavity 18 to close off the cavity 18 when water is no longer being injected into the cavity 18 through the water lines 72 (FIG. 4) and the intake aperture 20. As also illustrated, the first piece 14 of the mold 12 includes an insulated material such that the first piece 14 may be referred to as the insulated piece 14, and likewise, the second piece 16 includes a metallic material, such that the second piece 16 may be referred to as the metallic piece 16. The metallic material of the second piece 16 has a higher thermal conductivity than the polymeric material of the first piece 14. The metallic material may include aluminum, copper, iron, and various types of steel, combinations thereof, and other conceivable metals that are generally known in the art. The polymeric material may include polyvinyl chloride (PVC), polyethylene, polypropylene, polyamides, rubbers, combinations thereof, and other conceivable polymers known in the art. It is also conceivable that the second piece 16 may include other materials having low thermal conductivity, such as ceramics, glass, combinations thereof, and other insulative materials known in the art.

Figure 5A:
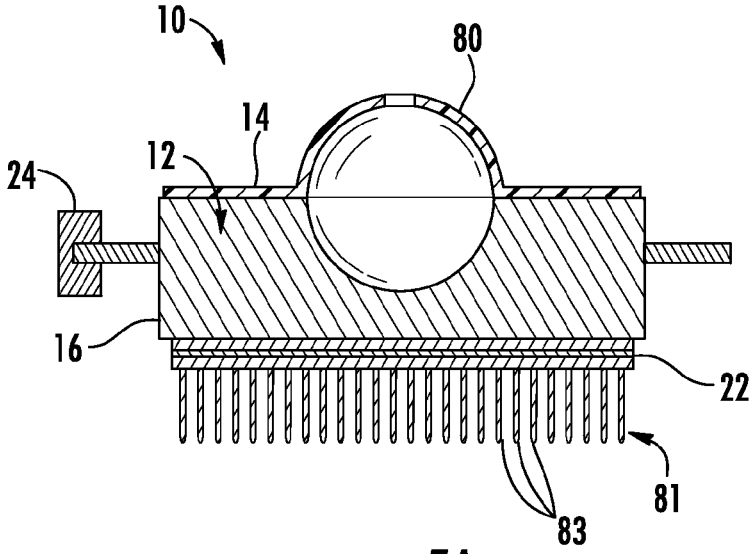
FIG. 5A is a cross-sectional side view of the additional embodiment of the ice maker of FIG. 4A.

In the additional embodiment, as illustrated in FIG. 5A, the insulated piece 14 of the mold 12 includes an alternative shape that maintains a consistent thickness surrounding the cavity 18 and contacting the metallic piece 16 of the ice mold 12. The reduced thickness in the insulated piece 14 allows for less thermal capacity in the insulated piece 14. Accordingly, it is conceivable that there may be alternative thicknesses and shapes of the insulated piece 14 of the ice mold 12. It is also conceivable that the metallic piece 16 of the ice mold 12 may be similarly shaped to include a consistent thickness surrounding the cavity 18, as shown by the insulated piece 14, to reduce the thermal capacity.

Figure 6:
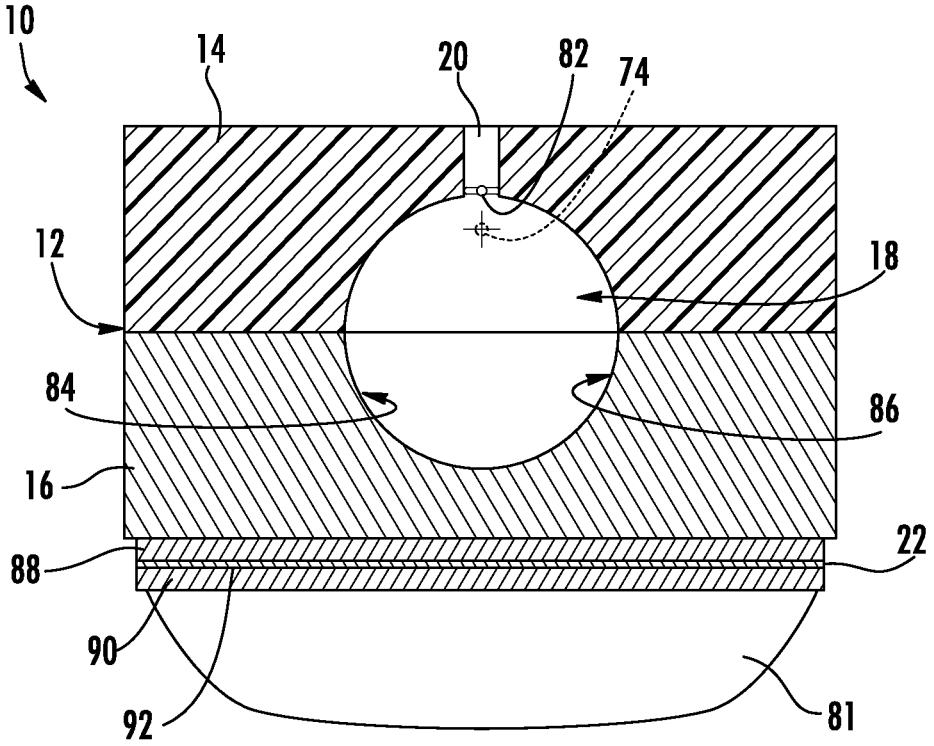
FIG. 6 is a cross-sectional front view of the ice maker of FIG. 4.

A cross-sectional view along the transverse axis 74 of the ice mold 12, as shown in FIG. 6, illustrates the cross-sectional area of the cavity 18. The cavity 18 includes a first side portion 84 and a second side portion 86, generally defined by a curved surface of the cavity 18. It is conceivable that the cavity 18 may include an alternative shape, such as a cylinder, an ovoid, a cube, a cone, and other shapes that may be desired, which may have alternatively shaped side portions. Further, the cross-sectional area of the thermoelectric device 22 is shown, wherein the cold side 88 is separated from the hot side 90 by an interconnect 92, as generally known in the art. When voltage is applied to the thermoelectric device 22 the Peltier effect creates the temperature drop and heat transfer of the thermoelectric device 22 between the cold side 88 and hot side 90.

Figure 6A:
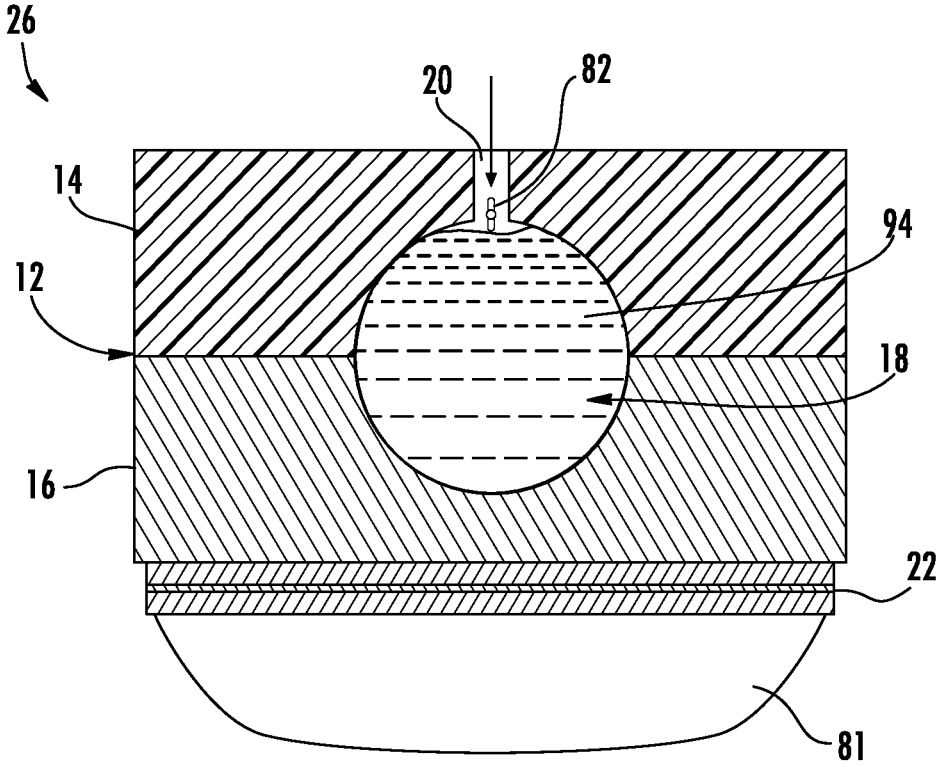
FIG. 6A is the cross-sectional view of FIG. 6 showing water injected into the cavity.
Figure 7A:
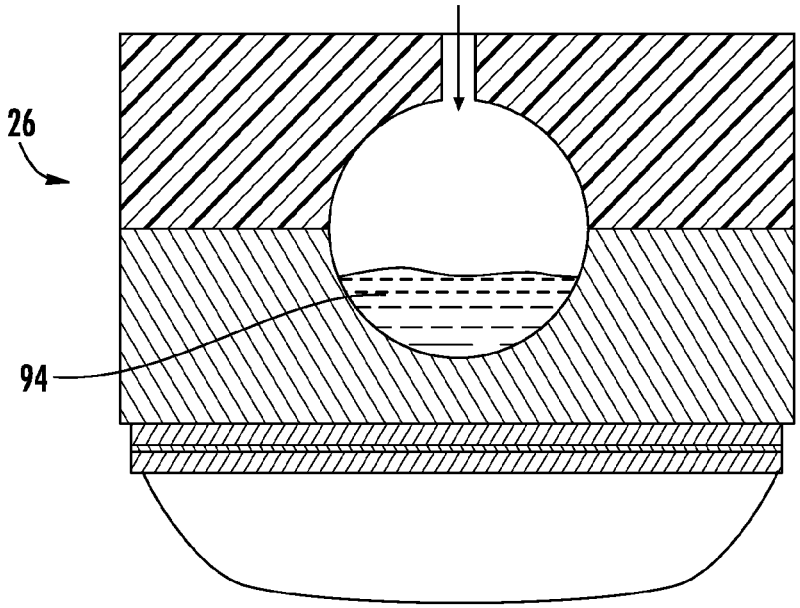
FIG. 7A is the cross-sectional view of FIG. 6 showing an incremental amount of water injected into the cavity.

In operation, the ice maker 10 cools the metallic piece 16 of the ice mold 12 with the cooling source 22 to a temperature substantially below freezing. This allows the water, once injected, to begin the freezing process immediately; however, the metallic piece 16 of the ice mold 12 also may begin to be cooled after the water is injected. The injection position 26, as shown in FIG. 6A, is defined by the position in which water 94 is injected into the cavity 18, such as the substantially vertical orientation illustrated. In the injection position 26, the valve 82 within the fluid intake aperture 20 is moved to an open position and water 94 is injected into the cavity 18 through the fluid intake aperture 20. It is conceivable that an incremental amount of water 94 is injected into the cavity 18, as illustrated in FIG. 7A, such that only a fractional portion of the cavity 18 is filled with water 94, such as less than one half of the cavity 18. Once at least the incremental amount of water 94 is injected into the cavity 18, the ice mold 12 is rotated about an axis of the cavity 18 from the injection position 26 to the tilted position 28.

Figure 6B:
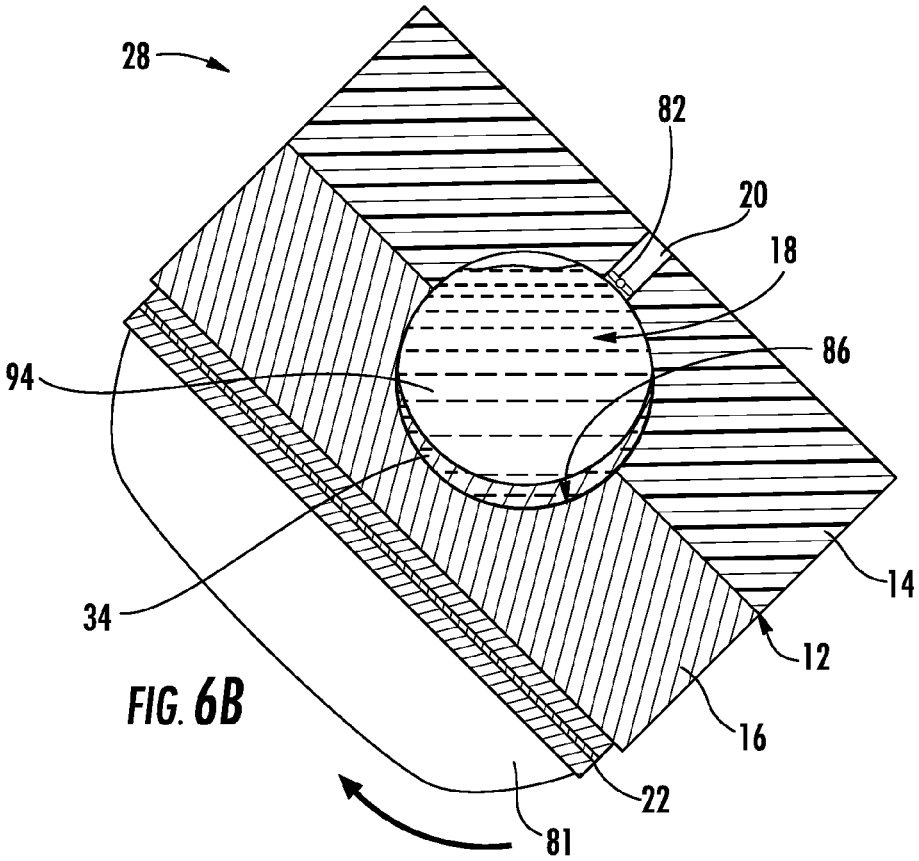
FIG. 6B is the cross-sectional view of FIG. 6 showing the mold rotated to a tilted position in a first direction.
Figure 7B:
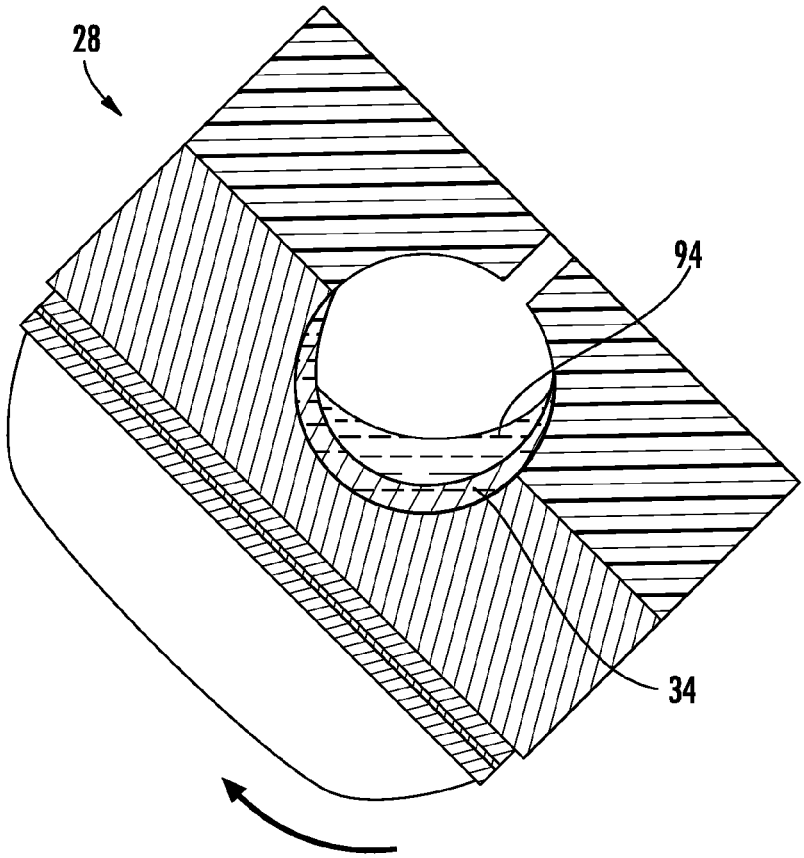
FIG. 7B is the cross-sectional view of FIG. 6 showing the mold rotated to a tilted position in a first direction.

The tilted position 28, as shown in FIG. 6B, includes the mold 12 rotated at least fifteen degrees from the injection position 26 to freeze water 94 on the side portion 30 of the cavity 18. As illustrated, the mold 12 is rotated a first direction at approximately a forty-five degree angle, moving the water in the cavity 18 to the second side portion 86 of the cavity 18. When an incremental amount of water 94 is injected into the cavity 18, as shown in FIG. 7B, the tilted position 28 may move the water 94 to the side portion of the cavity 18 below the intake aperture 20, preventing the water 94 from exiting the cavity 18 of the aperture 20. As such, the importance of the valve 82 in retaining water in the cavity 18 when the cavity 18 rotates to the tilted position 28 is reduced and the valve 82 may not be included in such an embodiment.

As also shown in FIG. 6B, the ice piece 34, upon its initial stages of formation, takes on a crescent cross-sectional shape, primarily formed proximate the metallic piece 16. The ice piece 34 slides within the cavity 18 maintaining a concave orientation within the cavity 18. It is also possible, as shown in FIG. 7B, that the ice piece 34 forms an interface with the metallic piece 16, such that the ice piece 34 does not slide within the cavity 18 upon formation. As the rotation of the ice mold 12 moves the water over the side portion 30 of the ice mold 12, gases may be released from the water 94 and exit the surface of the water 94, thereby creating a substantially clear ice piece 34. The insulated piece 14 of the ice mold 12 conducts a small amount of the cold temperature from the metallic piece 16, thereby maintaining a temperature substantially above freezing to prevent the surface of the water 94 from freezing.

Figure 6C:
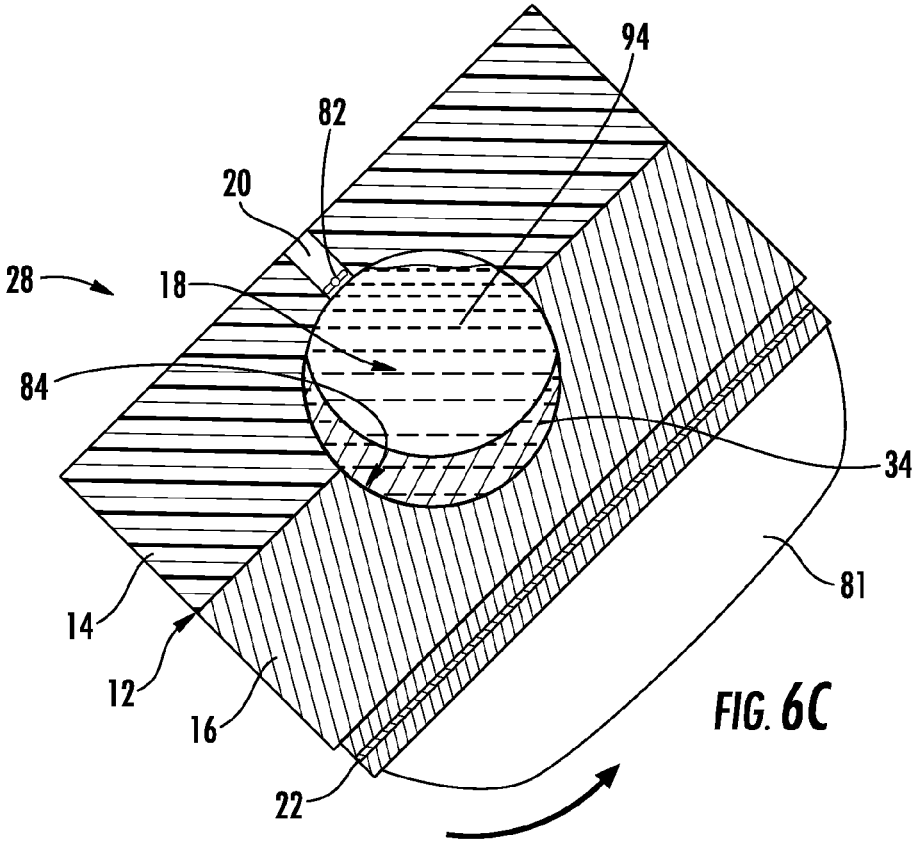
FIG. 6C is the cross-sectional view of FIG. 6 showing the mold rotated to the tilted position in a second direction.
Figure 7C:
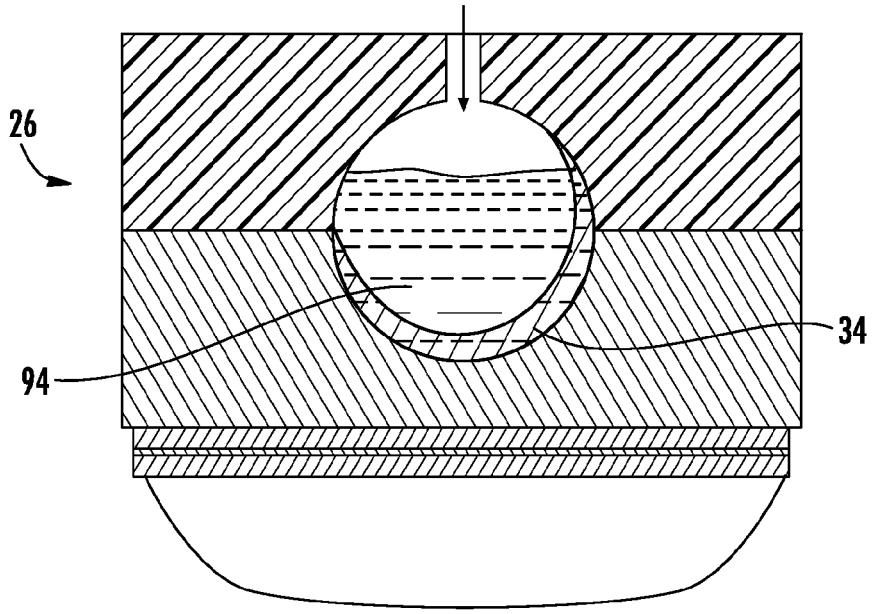
FIG. 7C is the cross-sectional view of FIG. 6 showing an incremental amount of water injected into the cavity with an ice piece.
Figure 7D:
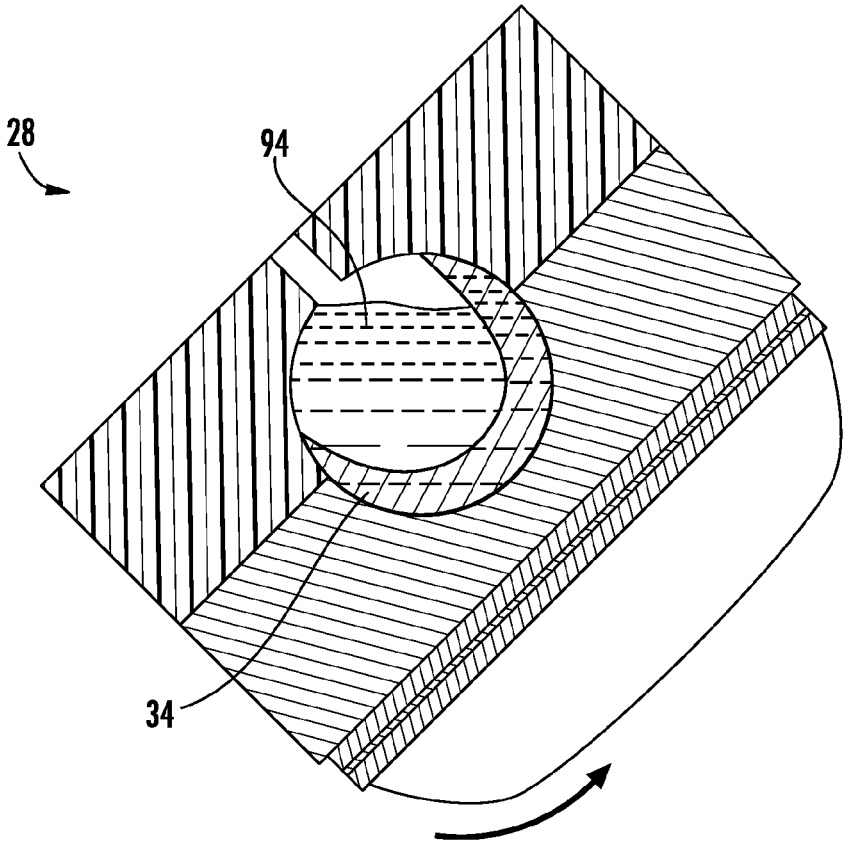
FIG. 7D is the cross-sectional view of FIG. 6 showing the mold rotated to a tilted position.
Figure 7E:
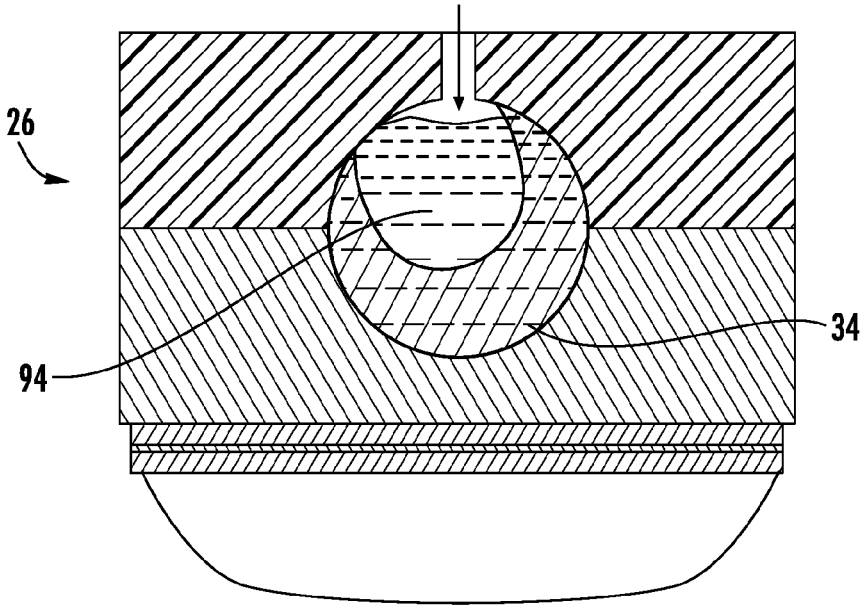
FIG. 7E is the cross-sectional view of FIG. 6 showing an incremental amount of water injected into the cavity with an ice piece.
Figure 7F:
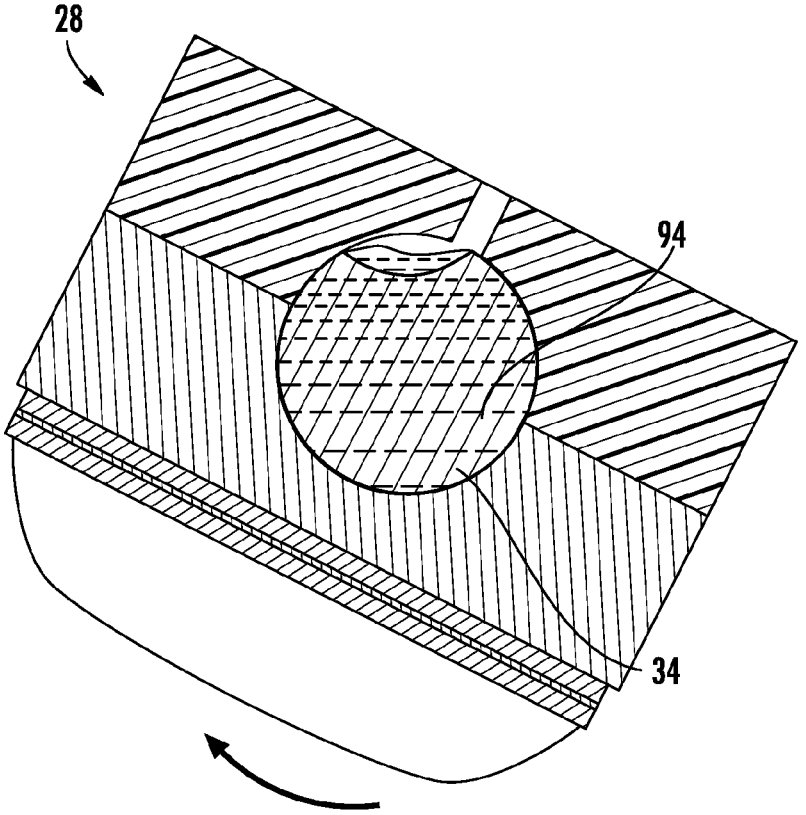
FIG. 7F is the cross-sectional view of FIG. 6 showing the mold rotated to a tilted position.

As illustrated in FIG. 6C, the ice mold 12 is rotated in a second direction at an angle of substantially forty-five degrees to the tilted position 28, moving the water 94 in the cavity 18 to the first side portion 84 of the ice mold 12. Again, when an incremental amount of water 94 is contained in the cavity 18, as shown in FIG. 7D, the rotation angle of the cavity 18 is configured to move the water 94 beyond the previously frozen edge of the ice piece 34 and below the intake aperture 20, such that the intake aperture 20 may receive the remaining incremental amounts of water 94 to fill the cavity 18. Once the ice mold 12 has rocked from the injection position 26 to the tilted position 28 and back to the injection position 26, an additional incremental amount of water 94 may be injected through the aperture 20 into the cavity 18, as shown in FIGS. 7C and 7E. The ice mold 12 may then resume the rocking cycle between injections, rotating the ice mold 12 into a tilted position 28, as shown in FIGS. 7D and 7F, until substantially all the water 94 in the cavity 18 has frozen. It is also conceivable that the entire cavity 18 may be injected with water 94 and oscillated in the ice making cycle between the first direction and the second direction, as shown in FIGS. 6B and 6C, until substantially all the water 94 contained in the cavity 18 has frozen.

Figure 6D:
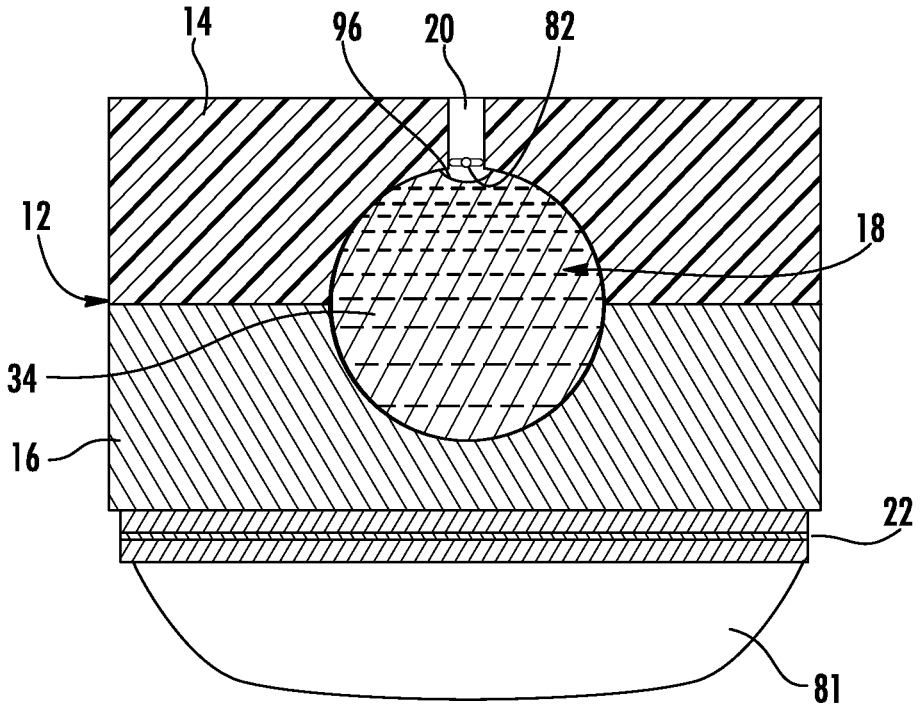
FIG. 6D is the cross-sectional view of FIG. 6 showing ice frozen in the cavity.
Figure 7G:
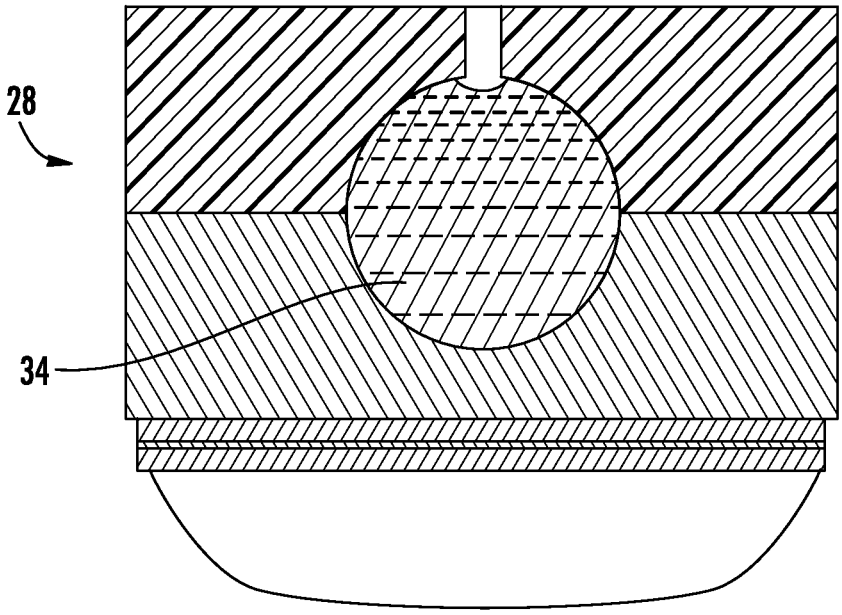
FIG. 7G is the cross-sectional view of FIG. 6 showing ice frozen in the cavity.

As illustrated in FIGS. 6D and 7G, the ice making cycle has completed and the ice mold 12 is rotated back to the injection position 26. The ice making cycle concludes when the ice piece 34 occupies substantially the entire fluid volume of the cavity 18, as illustrated. An eyelet 96 is formed in the ice piece 34 proximate the fluid intake aperture 20 upon completion of the ice making cycle. The eyelet 96 includes a substantially concave curvature resulting from the rocking and freezing characteristics of the ice making cycle.

Figure 8:
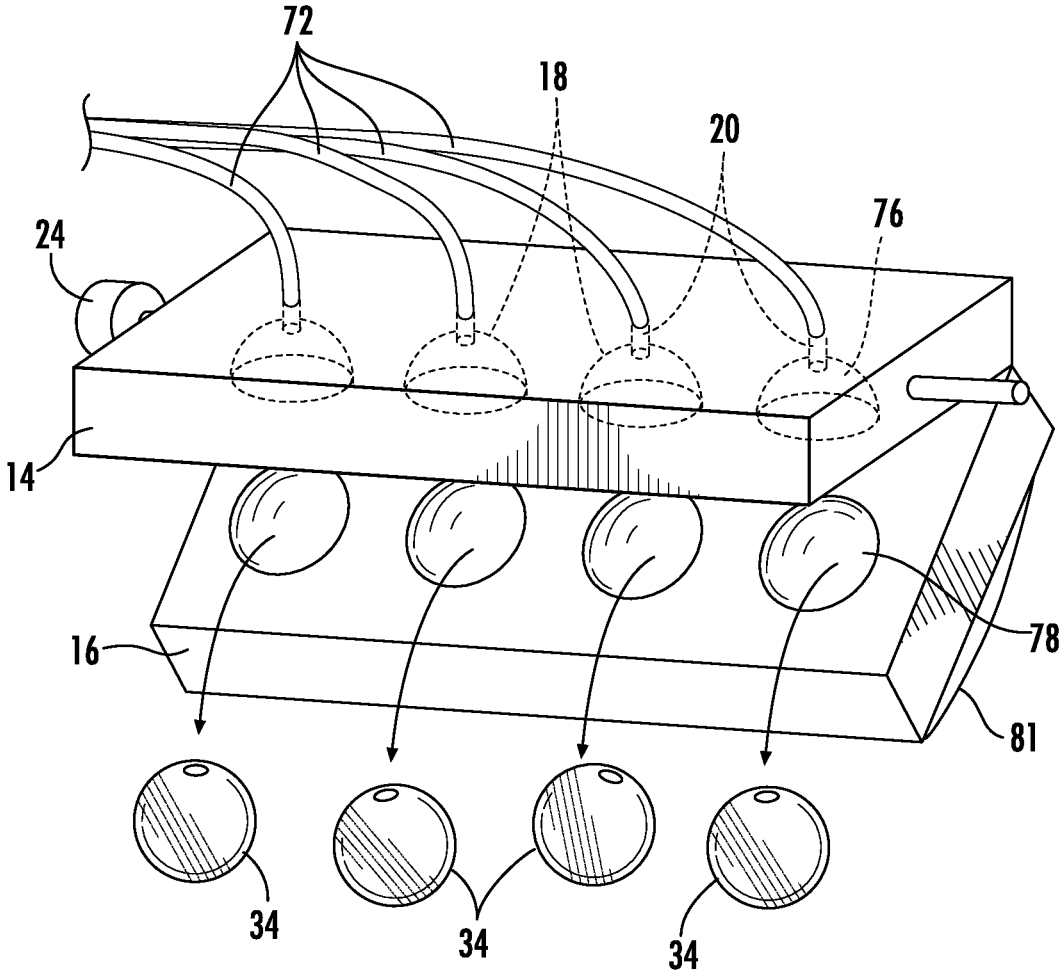
FIG. 8 is a top perspective view of the ice maker with the mold in an open position.
Figure 8A:
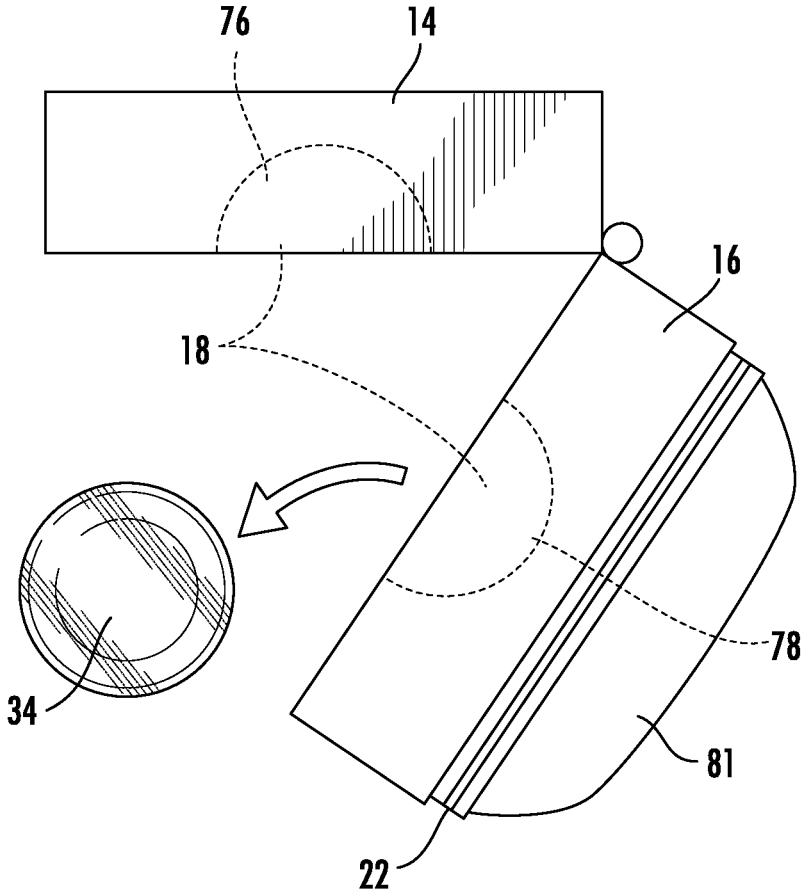
FIG. 8A is a cross-sectional side view of the ice maker of FIG. 7 with the mold in the open position releasing an ice piece.

As illustrated in FIG. 8, the insulated piece 14 is disengaged from the metallic piece 16 that is rotatably coupled with the insulated piece 14 of the ice mold 12 along a periphery edge there between. Upon completion of the ice making cycle, the metallic piece 16 disengages from the insulated piece 14 to release the spherical ice piece 34 from the ice mold 12. The metallic piece 16 pivots away from the insulated piece 14 when the metallic piece 16 is disengaged from the insulated piece 14. As also illustrated in FIG. 8A, the metallic piece 16 is rotated down and away to release the spherical ice piece 34 from the ice mold 12. It is also conceivable that an ejector pin may be disposed within the metallic piece 16 of the ice mold 12 that is deployed upon disengaging and rotating the metallic piece 16 away from the insulated piece 14 of the ice mold 12, such that the ejector pin dislodges the interface between the ice piece 34 and the metallic piece 16.

Figure 9:
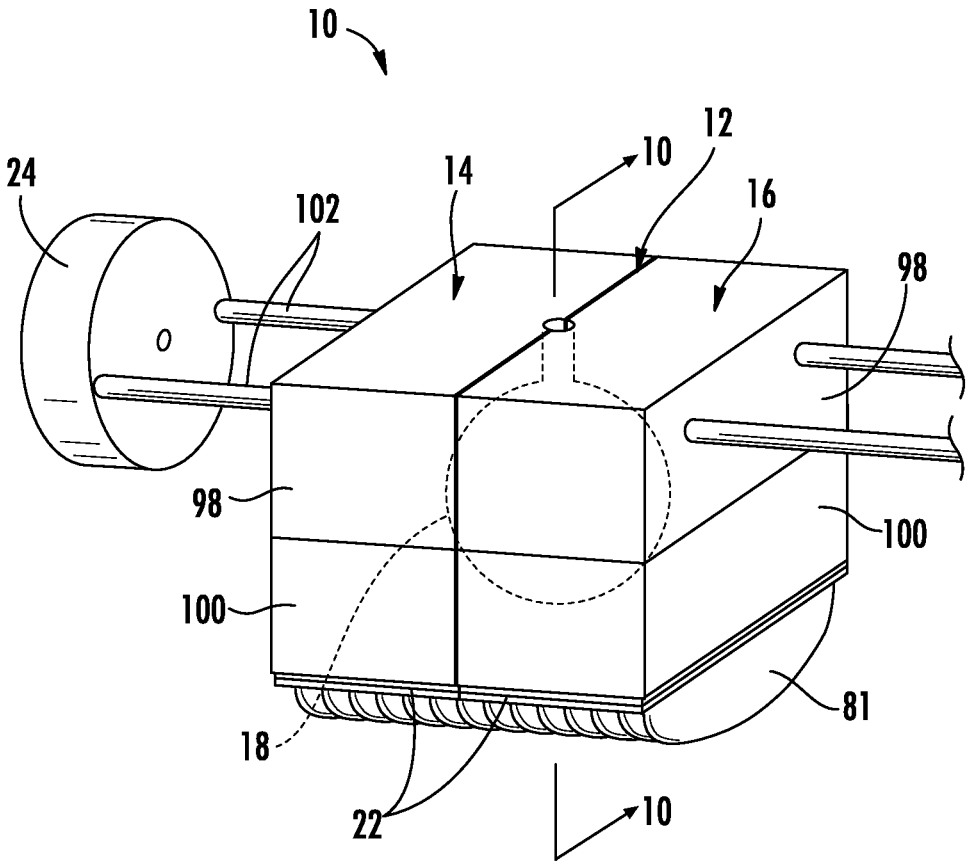
FIG. 9 is a top perspective view of an additional embodiment of the ice maker.
Figure 10:
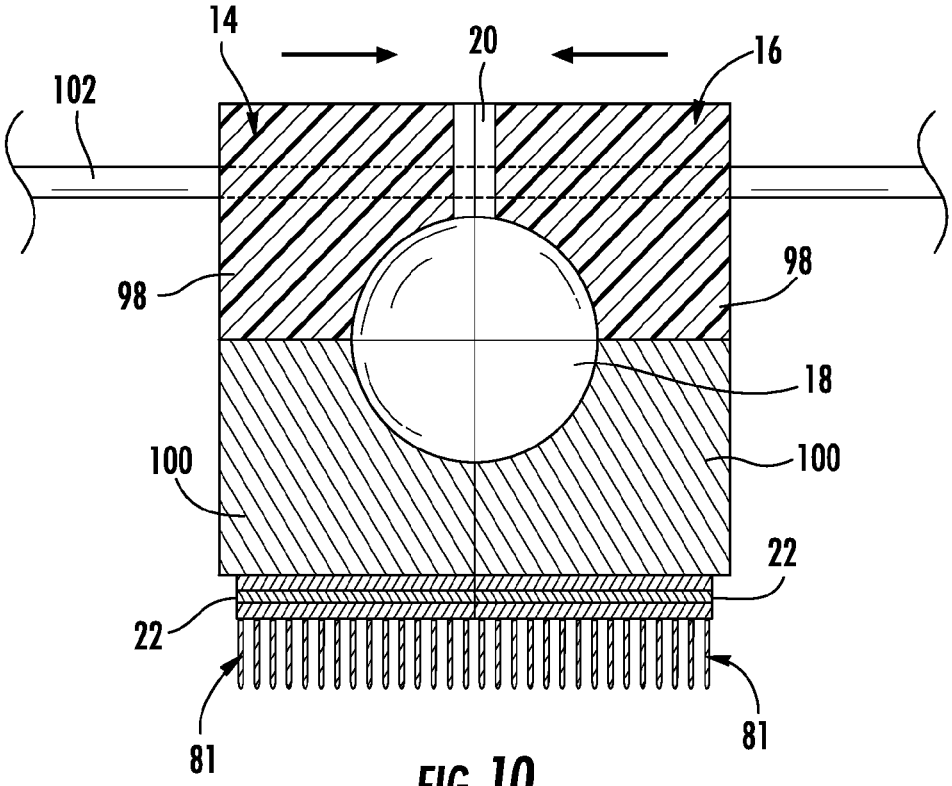
FIG. 10; is a cross-sectional side view of the additional embodiment of FIG. 8.
Figure 10A:
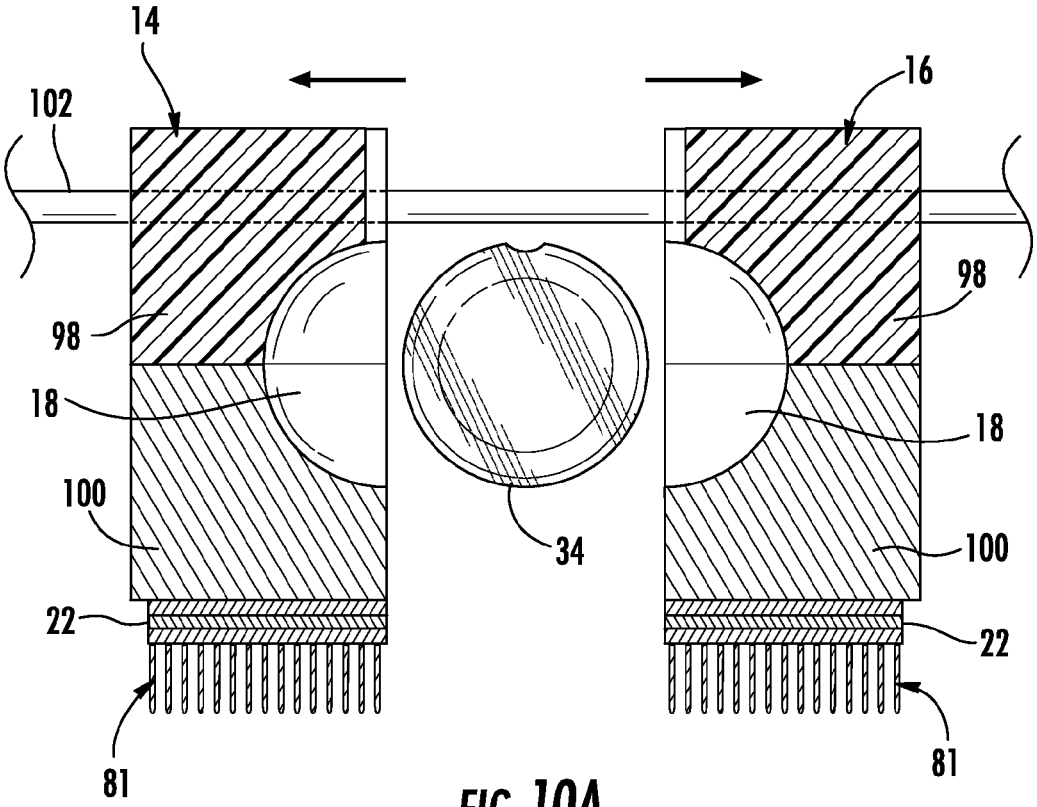
FIG. 10A is a cross-sectional side view of the additional embodiment of FIG. 8 with the mold in the open position.

An additional embodiment of the ice maker 10, as illustrated in FIG. 9, includes a first piece 14 of the ice mold 12 that has an insulated portion 98 and a metallic portion 100. The second piece 16 similarly includes an insulated portion 98 and a metallic portion 100. The metallic portions 100 and the insulated portions 98 are fixably coupled with each other. The first piece 14 and second piece 16 removably engage, such that the metallic portions 100 and the insulated portions 98 align to substantially enclose an ice cavity 18 there between. Further, two rails 102 slideably engage and extend through the insulated portions 98 of the first piece 14 and the second piece 16. The rails 102 horizontally and linearly extend through the insulated portions 98 of the first and second pieces 14, 16 of the ice mold 12. At least one of the first and second pieces 14, 16 is configured to linearly slide on the rails 102 to engage and disengage other of the first and second pieces 14, 16 of the mold 12. A drive body 24 is coupled with the rails 102 at one end to rotate the mold 12 in the ice making cycle between the injection position 26 and tilted position 28. Also, in such an embodiment, two separate thermoelectric devices 22 are coupled with each bottom surface of the metallic portions, and similarly including separate heat sinks 81. It is conceivable that the thermoelectric devices 22 may be coupled with alternative surfaces of the metallic portions 100 to freeze water within the cavity 18.

As illustrated in FIG. 9, the spherical cavity 18 within the ice mold 12 is positioned such that the cavity 18 is equally divided into two sections. The injection position 26 of such an embodiment, as illustrated in FIG. 9, includes the first and second pieces 14, 16 engaged and abutting one another to fluidly enclose the cavity 18. Upon injecting the cavity 18 with at least an incremental amount of water, the ice mold 12 is rotated in the ice making cycle about a transverse axis 74 substantially aligned with and positioned between the rails. As illustrated in FIG. 9A, the ice making cycle is concluded and the ice piece 34 substantially occupies the volume of the cavity 18. The ice maker 10 may be operated such that the ice piece 34 is substantially clear. The ice piece 34 is then ejected from the cavity 18 by linearly disengaging the first piece 14 of the ice mold 12 from the second piece 16 of the ice mold 12. Linearly separating the first piece 14 from the second piece 16 allows the ice piece 34 to fall down from the ice mold 12 with the force of gravity to an ice storage bin or another conceivable presentation area that is accessible to a user.

It will be understood by one having ordinary skill in the art that construction of the described invention and other components is not limited to any specific material. Other exemplary embodiments of the invention disclosed herein may be formed from a wide variety of materials, unless described otherwise herein. In this specification and the amended claims, the singular forms "a," "an," and "the" include plural reference unless the context clearly dictates otherwise.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An ice maker comprising:

an ice mold that includes an insulated piece and a metallic piece;

a cooling source thermally coupled to the metallic piece;

a cavity within the ice mold having a first reservoir in the metallic piece and a second reservoir in the insulated piece, wherein the first and second reservoirs align to substantially enclose the cavity;

a fluid intake aperture in the insulated piece that extends to the cavity for receiving water; and a drive body rotatably coupled to the ice mold that is configured to operate in an ice-making cycle, wherein the drive body repeatedly rotates the mold from an injection position to a tilted position, and wherein the cavity receives an incremental amount of water in the injection position and moves to the tilted position to freeze at least a portion of the incremental amount of water over a side surface of the cavity to make an ice piece; wherein the incremental amount of water input into the cavity is in direct contact with both the insulated piece and the metallic piece of the ice mold.

2. The ice maker of claim 1, wherein the tilted position includes the mold rotated a first direction at an angle, moving the water in the cavity to a first side of the cavity below the intake aperture, and a second direction at the angle, moving the water in the cavity to a second side of the cavity below the intake aperture; and wherein the rotation causes the ice piece to form an interface with the metallic piece of the ice mold to prevent sliding of the ice piece within the cavity.

3. The ice maker of claim 2, wherein the first direction is opposite the second direction, and wherein the angle is configured to move water beyond an edge of the ice piece that is forming on the first side and the second side.

4. The ice maker of claim 1, wherein the incremental amount of water is less than half of the fluid volume of the cavity, and wherein the ice-making cycle concludes when the ice piece occupies the fluid volume of the cavity.

5. The ice maker of claim 1, wherein the cavity includes a spherical shape, and wherein the insulated piece of the mold includes a polymeric material and has a lower thermal conductivity than the metallic piece.

6. The ice maker of claim 5, wherein the metallic piece is removably engaged with the insulated piece, and wherein the metallic piece disengages from the insulated piece to release the ice piece upon completion of the ice-making cycle.

7. The ice maker of claim 1, wherein the ice mold includes a plurality of cavities linearly arranged, and wherein the drive body is configured to rotate the ice mold along a transverse axis of the plurality of cavities.

8. The ice maker of claim 1, further comprising:

a housing substantially surrounding the ice mold, wherein the housing includes a liner of a door of an appliance.

9. The ice maker of claim 1, further comprising:

a storage bin positioned to receive an ice piece formed in the cavity when the metallic piece and the insulated piece disengage to release the ice piece.

* * * * *